US006474256B1

(12) United States Patent
Vogel

(10) Patent No.: US 6,474,256 B1
(45) Date of Patent: Nov. 5, 2002

(54) DINGHY LIFT

(75) Inventor: Wayne A. Vogel, Montague, MI (US)

(73) Assignee: Shore-Mate Industries, Inc., Rockford, MI (US)

( * ) Notice: Subject to any disclaimer, the term of this patent is extended or adjusted under 35 U.S.C. 154(b) by 0 days.

(21) Appl. No.: 09/910,240

(22) Filed: Jul. 20, 2001

(51) Int. Cl.[7] ..... B63B 23/02
(52) U.S. Cl. ..... 114/368; 114/369; 114/259
(58) Field of Search ..... 114/365, 367, 114/368, 369, 373

(56) References Cited

U.S. PATENT DOCUMENTS 4,878,450 A 11/1989 Schmidt, Jr.
5,133,275 A * 7/1992 Maurizio ..... 114/259
5,544,606 A 8/1996 Schmidt, Jr.
6,047,659 A * 4/2000 Schmidt, Jr. ..... 114/369
6,327,992 B1 * 12/2001 Martin ..... 114/259

FOREIGN PATENT DOCUMENTS

EP 00153248 * 8/1985 ..... 114/368

* cited by examiner

*Primary Examiner*—Stephen Avila
(74) *Attorney, Agent, or Firm*—Warner Norcross & Judd

(57) ABSTRACT

A dinghy lift for mounting to a boat beneath a swim platform. The dinghy lift includes a pair of space-apart lift mechanisms that are mounted to the stern beneath the swim platform. The lift mechanisms do not extend outwardly beyond the swim platform and therefore are generally hidden from view. A pair of arm are removably mounted to the lift mechanisms. The arms extend outwardly beyond the swim platform to form a cradle for the dinghy. The lift mechanisms selectively move the arms between a lowered position for loading and unloading the dinghy and a raised position for storing the dinghy.

27 Claims, 14 Drawing Sheets

DINGHY LIFT

BACKGROUND OF THE INVENTION

The present invention relates to marine accessories, and more particularly to a dinghy lift for a boat.

It is common for boats of medium or larger size to carry a dinghy as a tender, for example, to travel between the boat and shore. With sailboats, the dinghy is often towed behind the boat, but with powerboats the dinghy is preferably carried out of the water where it will have less impact on boat performance. There are a variety of mechanisms for carrying a dinghy out of the water. Perhaps the most common of these is a davit. A davit is a small crane-like device that is mounted near the side of the boat. A typical davit includes a hoist for lifting the dinghy out of the water and either holding the dinghy above the water or placing it on the deck of the boat for storage. With many powerboats, one or two davits are located near the stern on or adjacent to the swim platform. This permits the dinghy to be suspended over or placed upon the swim platform for storage. Although davits provide an effective mechanism for lifting and lowering a dinghy, they suffer from a number of disadvantages. First, they occupy space on the deck of the boat. This is a particular acute problem because of the limited deck space that is available on a boat. Second, they are commonly placed at the stern of the boat and therefore may interfere with use of the swim platform. Third, davits are considered aesthetically displeasing by many boat owners. These problems are compounded in that davits are typically permanently mounted to the boat and cannot easily be removed when not in use.

To address these problems, it is known to provide a boat with a moving swim platform that functions as a dinghy lift. The swim platform can be lowered into the water to load and unload a dinghy or raised for storage of the dinghy. Although the moving swim platform eliminates the need for bulky and unsightly davits, it suffers from a number of disadvantages. First, moving swim platforms typically require significant modification to the boat and are therefore relatively expensive. Further, when stored, the dinghy occupies the swim platform making it unavailable for other uses.

SUMMARY OF THE INVENTION

The aforementioned problems are overcome by the present invention wherein a dinghy lift is provided that mounts to the stern of the boat hidden from sight beneath the swim platform. The dinghy lift includes arms that extend beyond the swim platform and are removable when the dinghy lift is not in use.

In a preferred embodiment, the dinghy lift includes a pair of hydraulic lift assemblies that are mounted to the exterior of the stern beneath the swim platform. Each lift assembly includes a tip assembly that is adapted to removably receive an arm. The tip assembly is mounted to a linkage that moves the arm (and consequently the dinghy) from a substantially level orientation to a slight inward tilt as the arm is raised. Further, the linkage preferably moves the arm (and consequently the dinghy) inwardly toward the swim platform as it is raised.

In a more preferred embodiment, the two hydraulic lift assemblies are interconnected by a cross member assembly. This enhances the structural integrity of the dinghy lift and helps to provide uniform movement of the left and right arms despite any uneven weight distribution.

In an even more preferred embodiment, the dinghy lift includes a remote control that permits operation of the lift from a remote location. The remote control is preferably a conventional UHF remote that permits the dinghy lift to be raised and lowered at the touch of a button.

The present invention provides a simple and effective dinghy lift that is mounted where it is hidden from sight and does not affect boat performance. The removable arms can be installed and removed as needed. The linkage tilts the dinghy inwardly as the arms are raised and moves the dinghy inwardly toward the swim platform as the dinghy is raised. This makes it easier to move between the boat and the dinghy. The remote control permits control of the lift from a remote location, for example, from inside the dinghy. Further, the dinghy lift is relatively inexpensive to install and maintain, requiring only minor modifications to the boat.

These and other objects, advantages, and features of the invention will be readily understood and appreciated by reference to the detailed description of the preferred embodiment and the drawings.

DETAILED DESCRIPTION OF THE PREFERRED EMBODIMENT

I. General Description of Structure and Operation

Figure 1:
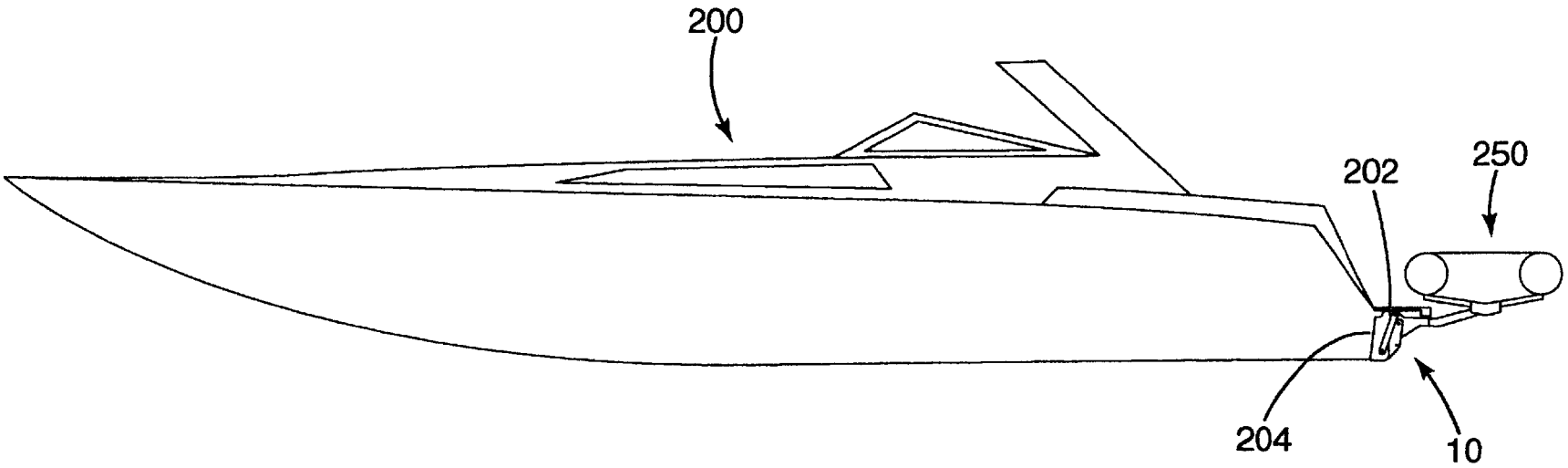
FIG. 1 is a side elevational view of a boat having a dinghy lift according to a preferred embodiment of the present invention with the dinghy lift in the raised position.
Figure 2:
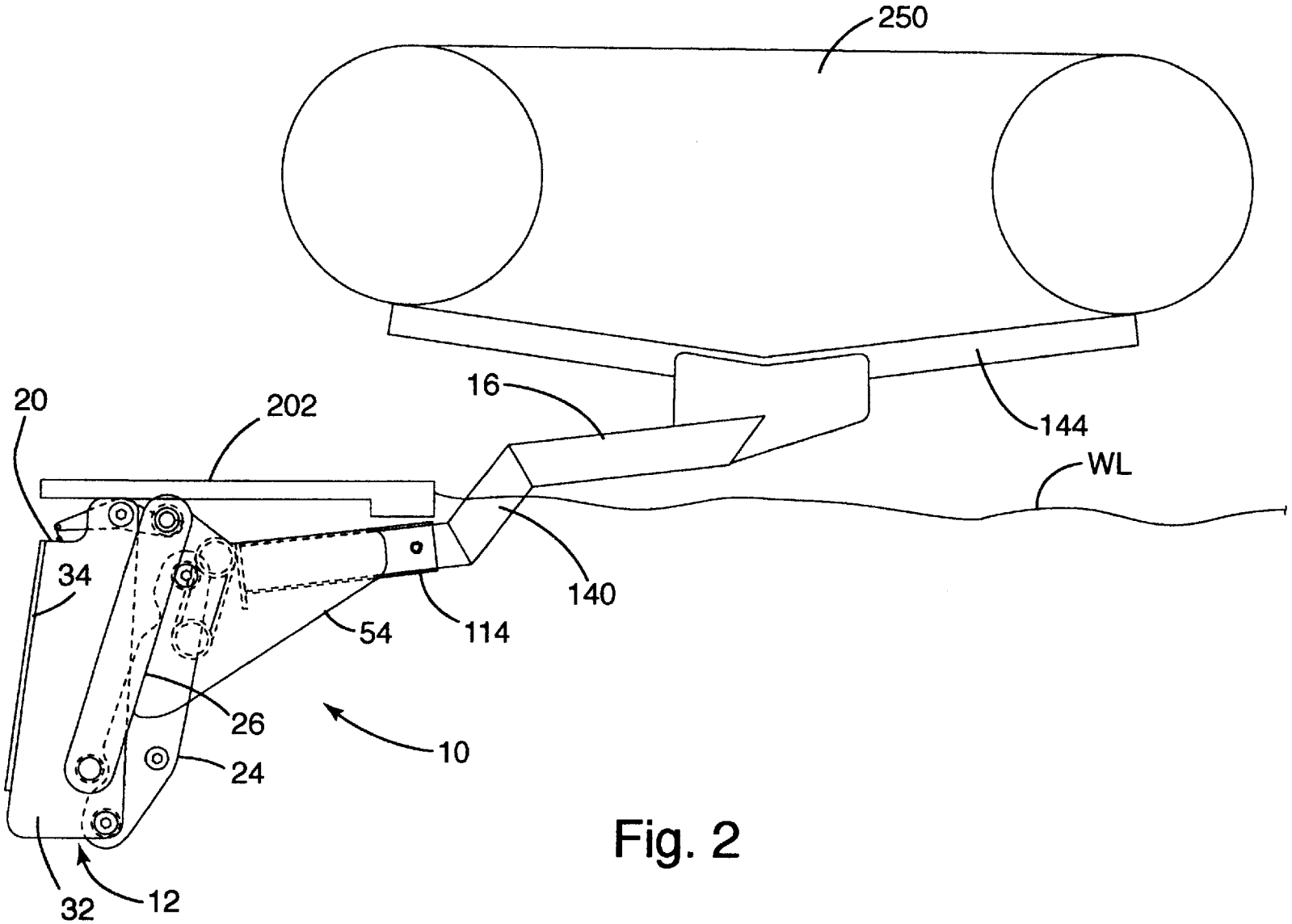
FIG. 2 is a side elevational view of the dinghy lift in a raised position.
Figure 3:
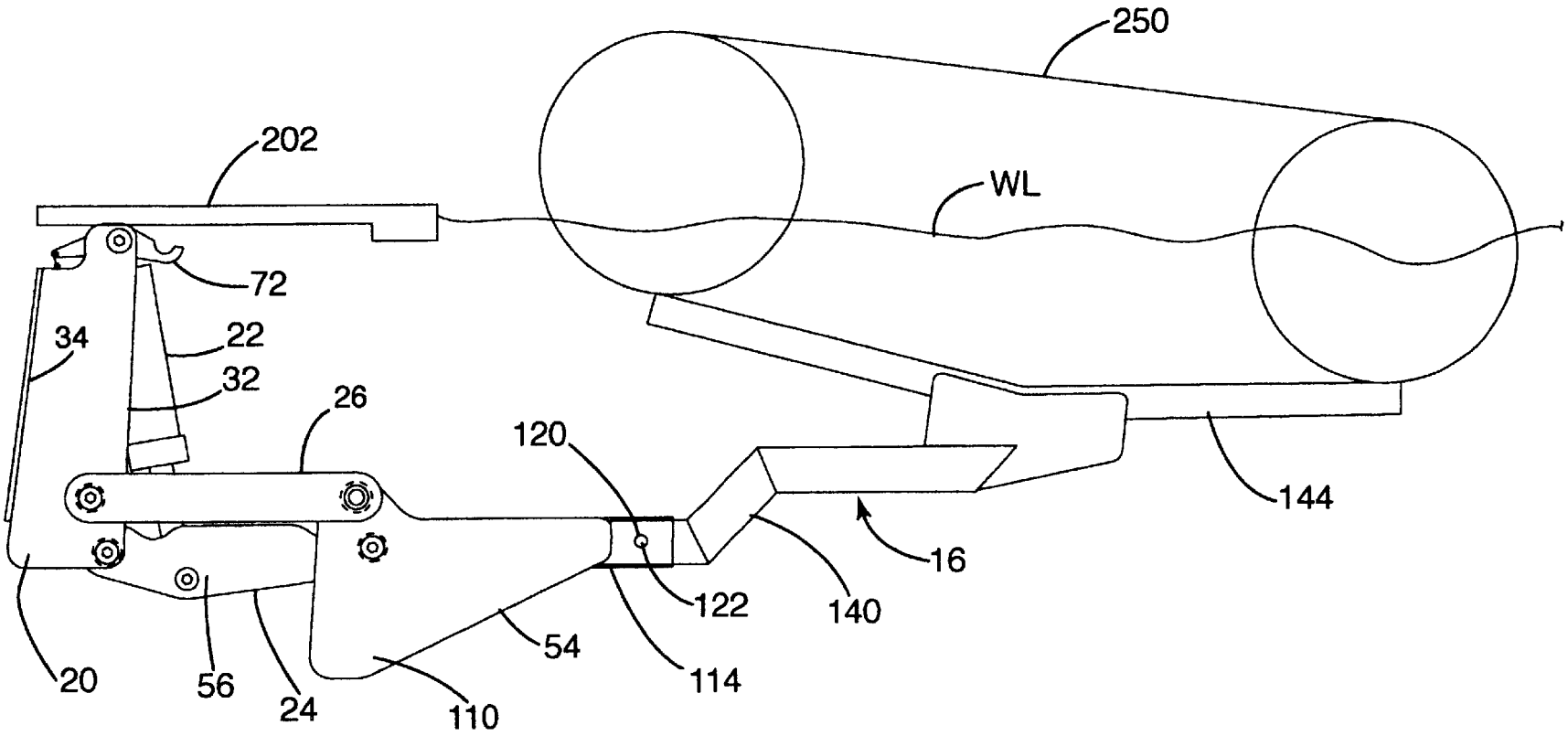
FIG. 3 is a side elevational view of the dinghy lift in a middle position.
Figure 4:
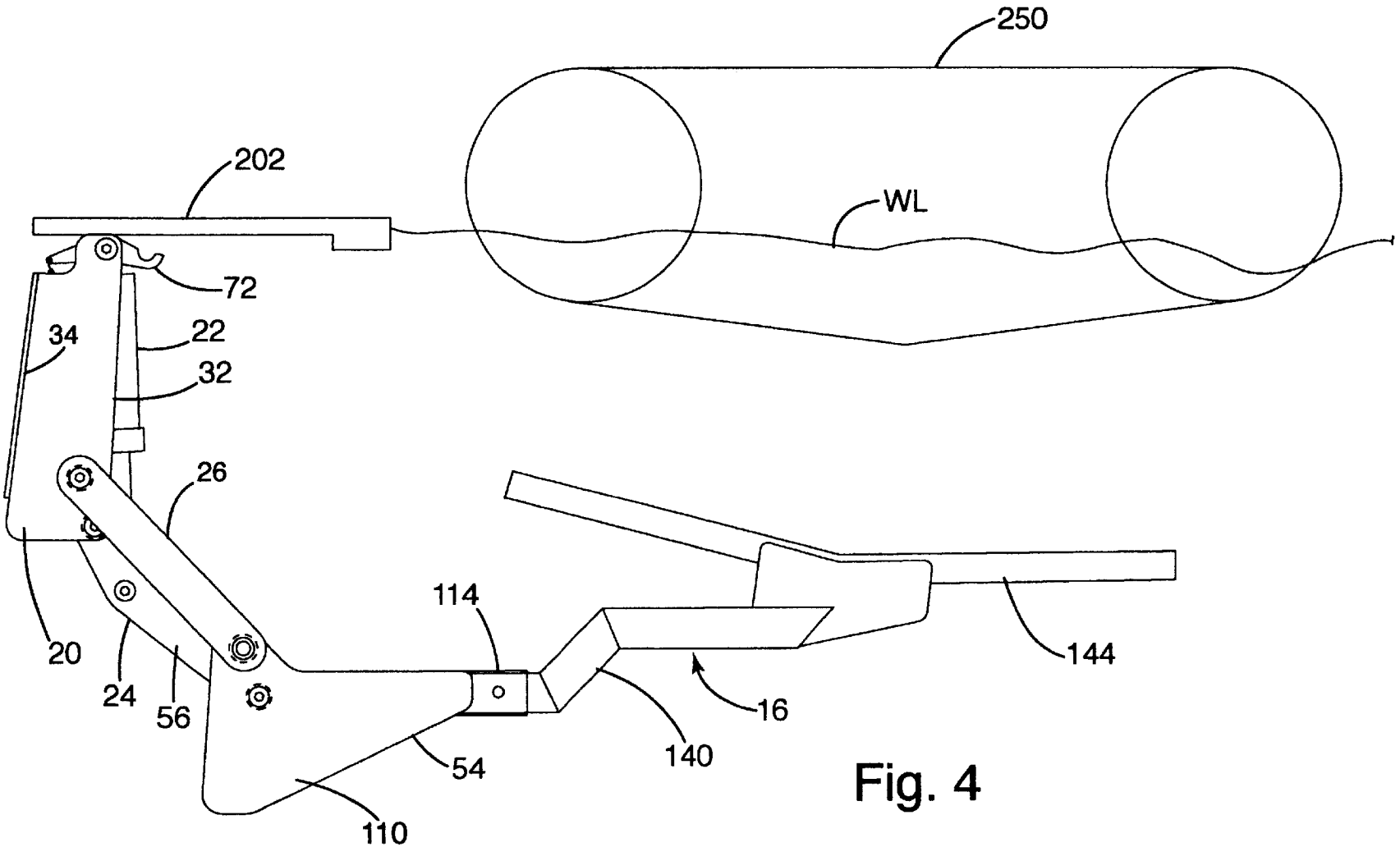
FIG. 4 is a side elevational view of the dinghy lift in the lowered position.

A boat having a dinghy lift in accordance with a preferred embodiment of the present invention is show in FIG. 1. The boat 200 includes a conventional swim platform 202. The dinghy lift 10 is mounted to the stern 204 beneath the swim platform and includes a pair of lift assemblies 12 and 14 that are mounted on opposite sides of the stern's vertical centerline. The lift assemblies 12 and 14 raise and lower a pair of arms 16 and 18 through operation of hydraulic cylinders 22. The arms 16 and 18 cradle the dinghy 250 lifting and lowering it with movement of the lift assemblies 12 and 14 (See FIGS. 2–4). In operation, the dinghy lift 10 is lowered beneath the waterline WL for loading and unloading the dinghy 250 and raised above the waterline WL to hold the dinghy 250 out of the water. The arms 16 and 18 are removably mounted to the lift assemblies 12 and 14 so that they can be removed when not in use. The present invention is described in connection with a boat having a slightly inclined, planar stern. The present invention is, however, well suited for and easily adapted to sterns of different shapes.

II. Detailed Description of Structure

Figure 5:
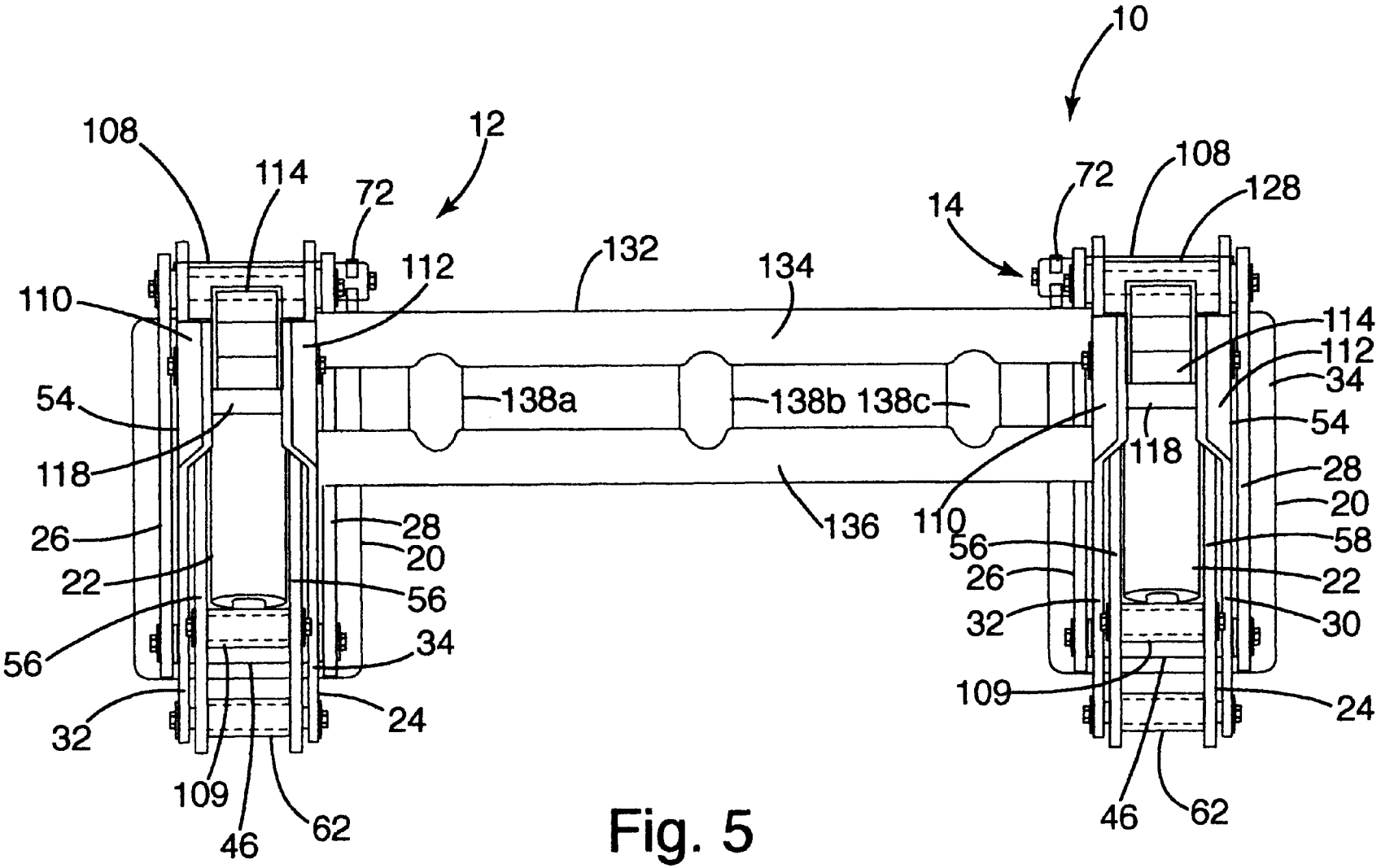
FIG. 5 is a front elevational view of the dinghy lift in the raised position.
Figure 6:
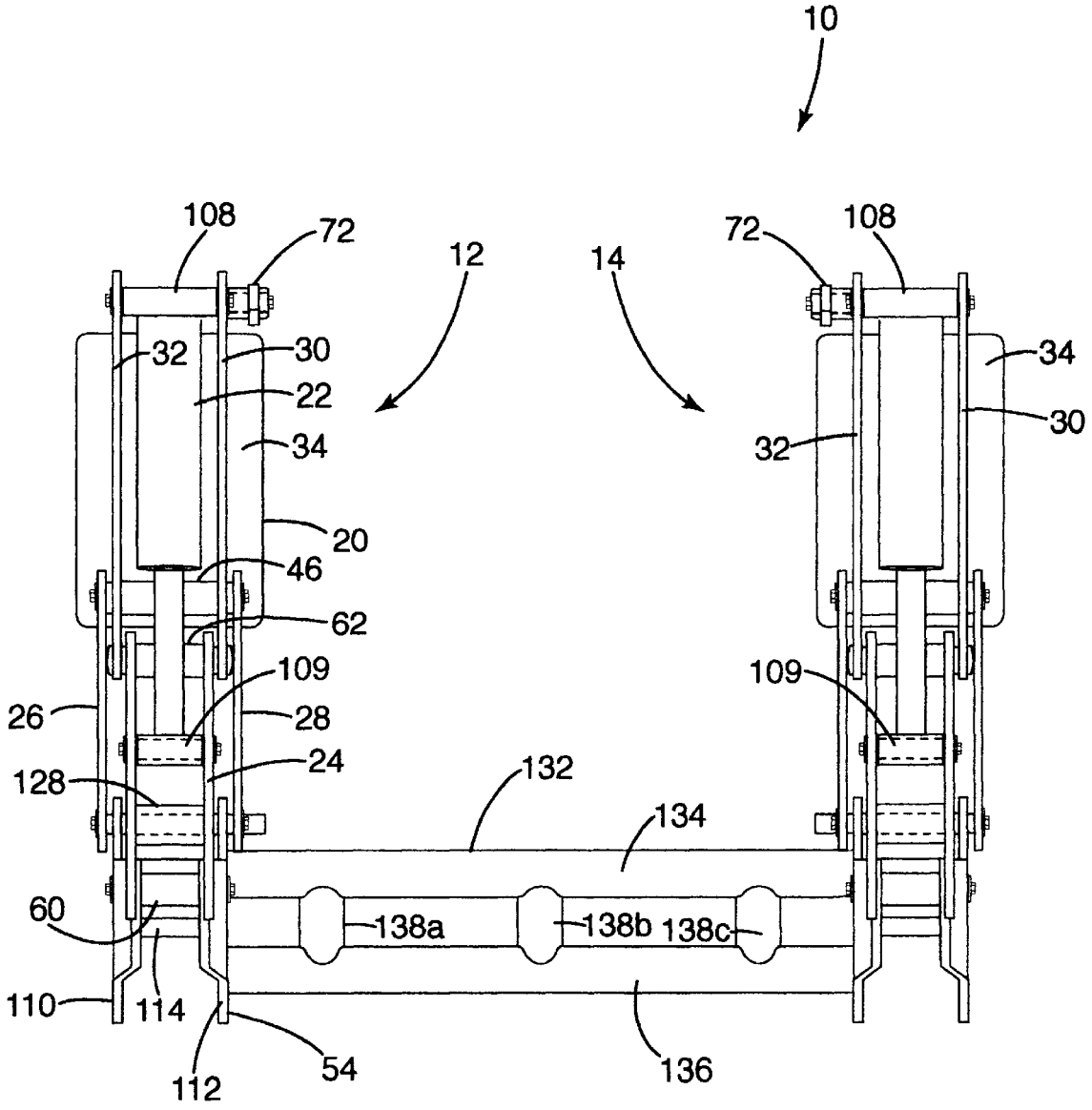
FIG. 6 is a front elevational view of the dinghy lift in the lowered position.
Figure 7:
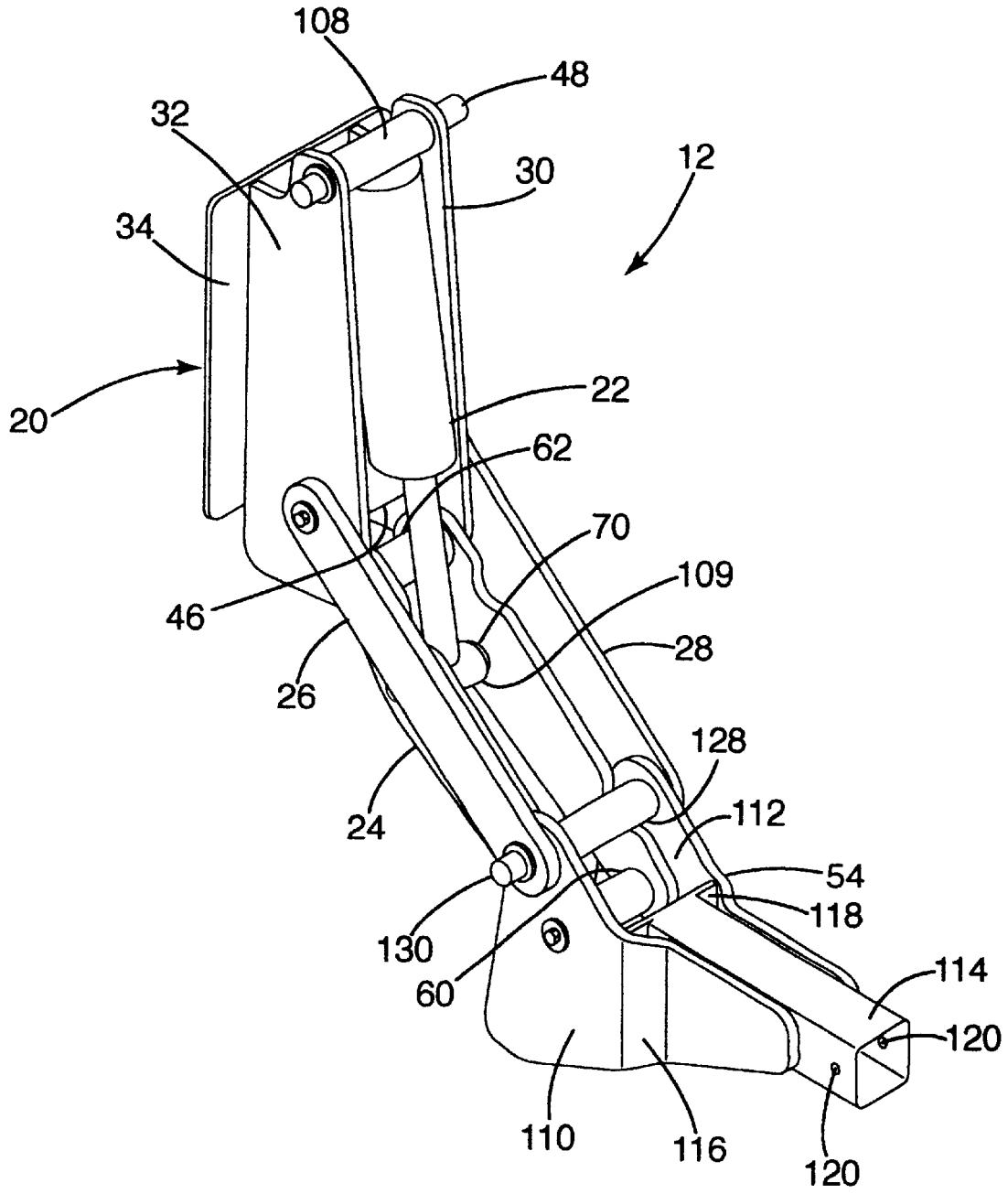
FIG. 7 is a perspective view of a lift assembly and tip assembly.
Figure 9:
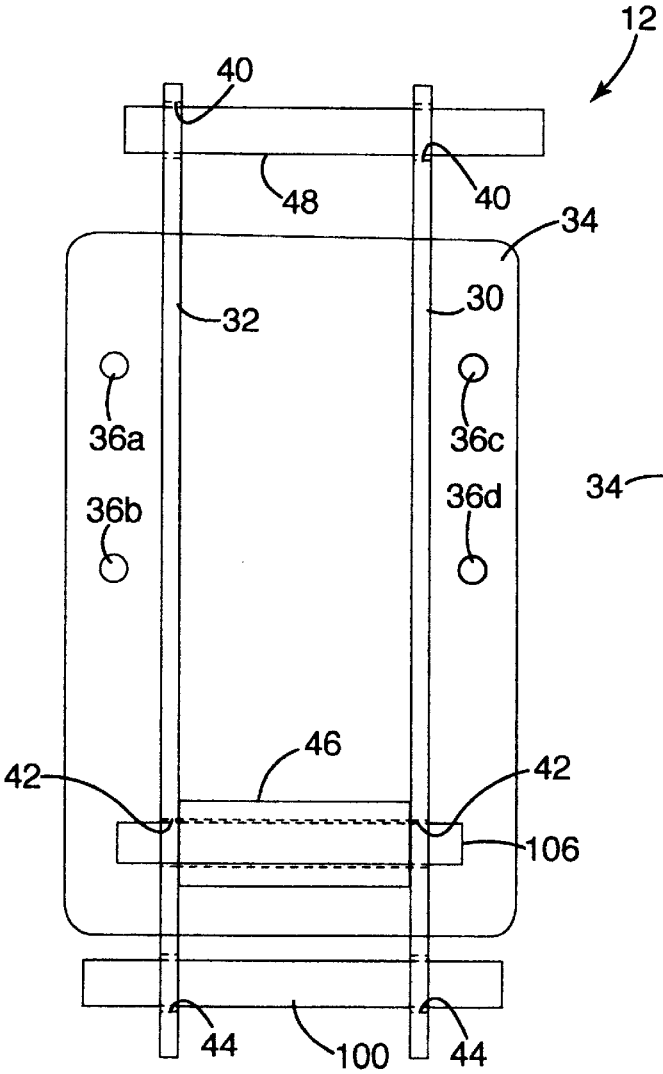
FIG. 9 is a front elevational view of the frame assembly.
Figure 10:
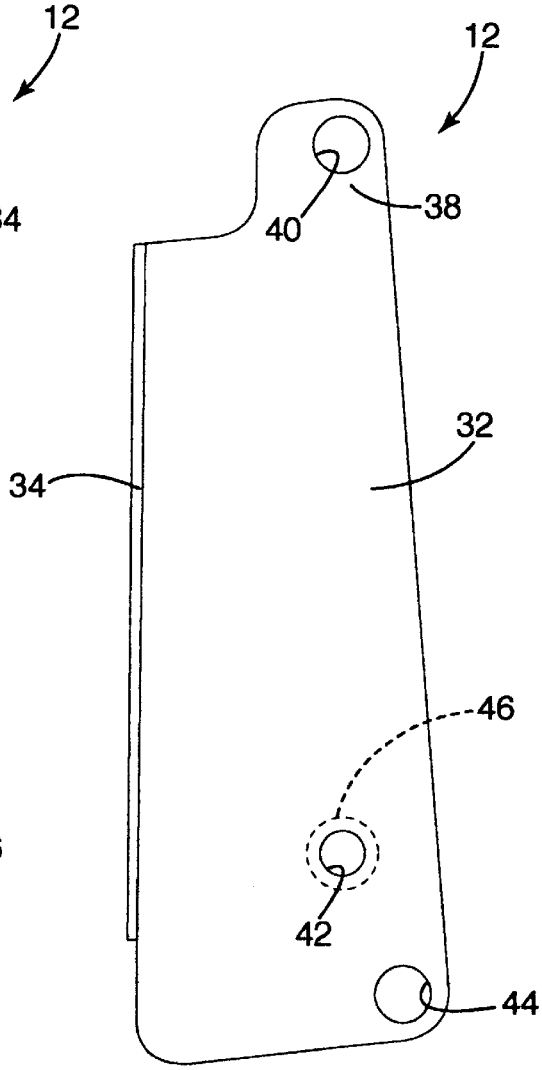
FIG. 10 is a side elevational view of the frame assembly.

The dinghy lift 10 includes a pair of lift assemblies 12 and 14 that are mounted toward opposite side of the stern 204 (See FIGS. 5 and 6). The two lift assemblies 12 and 14 are essentially identical, and therefore only lift assembly 12 will be described in detail. Referring now to FIG. 7, lift assembly 12 generally includes a frame assembly 20, a hydraulic cylinder 22, a lever assembly 24 and a pair of outer arms 26 and 28. As perhaps best shown in FIGS. 9 and 10, the frame assembly 20 includes a pair of frame sides 30 and 32 extending from a mounting plate 34. The mounting plate 34 is a planar, generally rectangular plate defining a plurality of mounting holes 36*a–d*. To facilitate mounting, the mounting plate 34 is shaped to follow the contour of the stern 204, which in this case is planar. In other applications, the mounting plate may have substantial shape as necessary to correspond in shape with the mounting surface. The frame sides 30 and 32 extend perpendicularly from the mounting plate 34 and are generally identical in shape. The frame sides 30 and 32 are preferably secured to the mounting plate 34 by welding. Each side 30 and 32 includes an ear 38 and defines a plurality of throughbores 40, 42 and 44. A sleeve 46 extends between the frame sides 30 and 32 in concentric alignment with throughbores 42. A rod 48 extends between throughbore 40 of frame side 30 and throughbore 40 of frame side 32 (See FIG. 7). As described in more detail below, the rod 48 provides a mount for the upper end of hydraulic cylinder 22. The rod 48 also preferably extends outwardly beyond the frame side 32 to provide a mount for latch 72. Opposite ends of the rod 48 are preferably drilled/tapped and secured to the frame assembly 20 by a pair of bolts and retaining washers. Another rod 100 extends between throughbore 44 on frame side 30 and throughbore 44 on frame side 32 (See FIG. 9). The rod 100 provides a pivotal mount for the lever assembly 24. A bronze bushing is preferably fitted into each throughbores 44. Further, a pair of bronze washers are preferably fitted over the rod 100 between the frame assembly 20 and the lever assembly 24. Opposite ends of the rod 48 are preferably drilled/tapped and secured to the frame assembly 20 by a pair of bolts and retaining washers.

Figure 16:
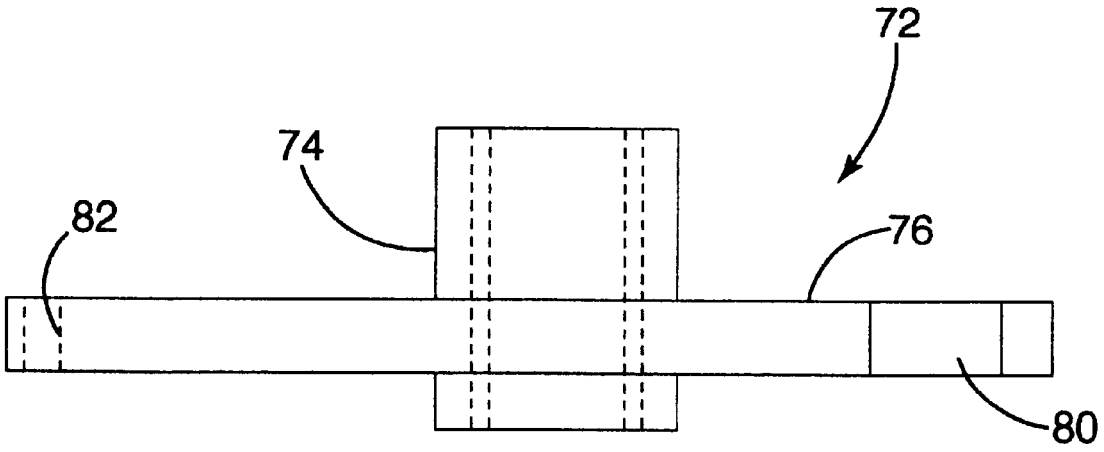
FIG. 16 is a top plan view of the latch.
Figure 17:
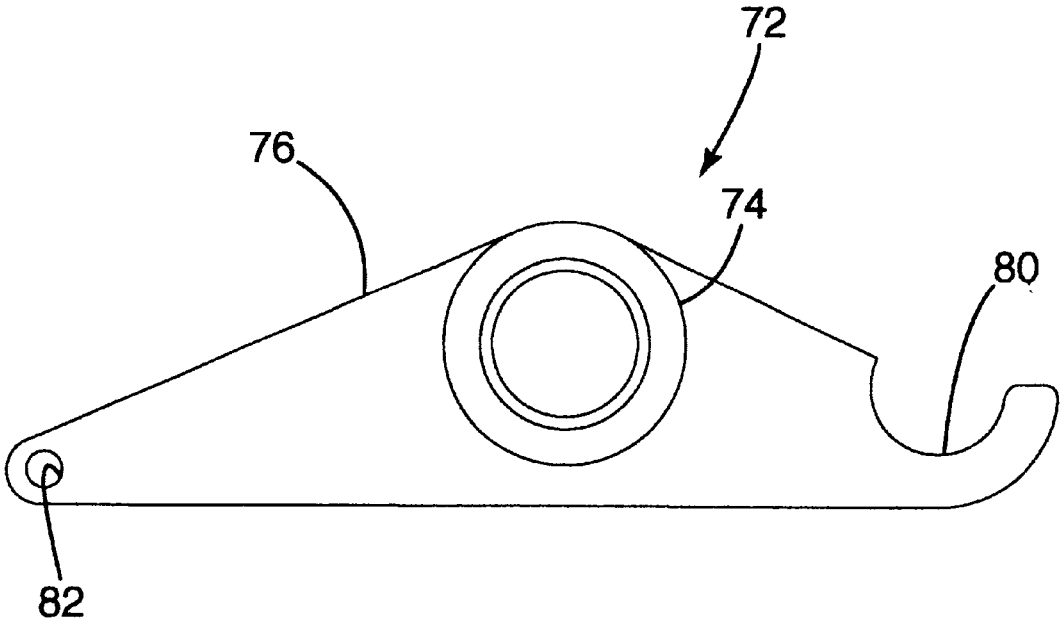
FIG. 17 is a side elevational view of the latch.

Each lift mechanism 12 and 14 preferably includes a latch assembly 88 that secures the lift assembly 12 and 14 in the raised position. The latch assembly 88 will be described in connection with FIG. 8, which shows lift mechanism 14 and its corresponding latch assembly 88. The latch assembly 88 of lift mechanism 12 is essentially identical to the described latch assembly 88. The latch assembly 88 generally includes a latch 72, a spring 84, a stop bolt 90, a spring mounting bolt 92 and a rope 94. The latch 72 is pivotally mounted over rod 48 and is selectively movable between (a) a closed position in which the latch 72 catches the sleeve 60 of the lever assembly 24 to lock the lift assembly 12 in the raised position and (b) an open position in which the latch 72 is disengaged from the sleeve 60 to permit movement of the lift assembly 12 (See FIG. 8, Arrow A). As shown in FIGS. 16 and 17, the latch 72 generally includes an arm 76 and a sleeve 74 extending perpendicularly through the arm 76. The arm 76 includes a hook 80 at one end and a spring mounting hole 82 at the other. The hook 80 is shaped to generally semi-circular and dimensioned to mate with sleeve 60. A bronze bushing 78 is preferably fitted within the sleeve 74. The spring 84 extends between the spring mount 82 and the spring mounting bolt 92, the latter of which is secured, for example, by threading, to the frame side 30. The spring 84 biases the latch 72 in the closed positioned. The stop bolt 90 is secured to frame side 30 to limit movement of the latch 72. The latch assembly 88 is preferably actuated by a rope 94 that is secured to the arm 76 at the same end as the spring mounting hole 82. By pulling the rope 94, the latch 72 pivots against the bias of the spring 84 into the open position. When the rope 94 is released, the spring 84 returns the latch 72 to the closed position. If desired, the rope 94 can be replaced by an automated actuator, for example, a solenoid (not shown) that can be actuated to engage and disengage the latch 72. Although separate ropes can be used, a single rope 94 is preferably secured to both latch assemblies 88 so that both lift assemblies 12 and 14 can be released by a single pull. In the described embodiment, a separate latch assembly 88 is mounted to each lift assembly 12 and 14. In some applications, a single latch assembly mounted to only one of the two lift assemblies 12 and 14 may be sufficient. In other applications, the latch assembly 88 may be eliminated altogether.

Figure 8:
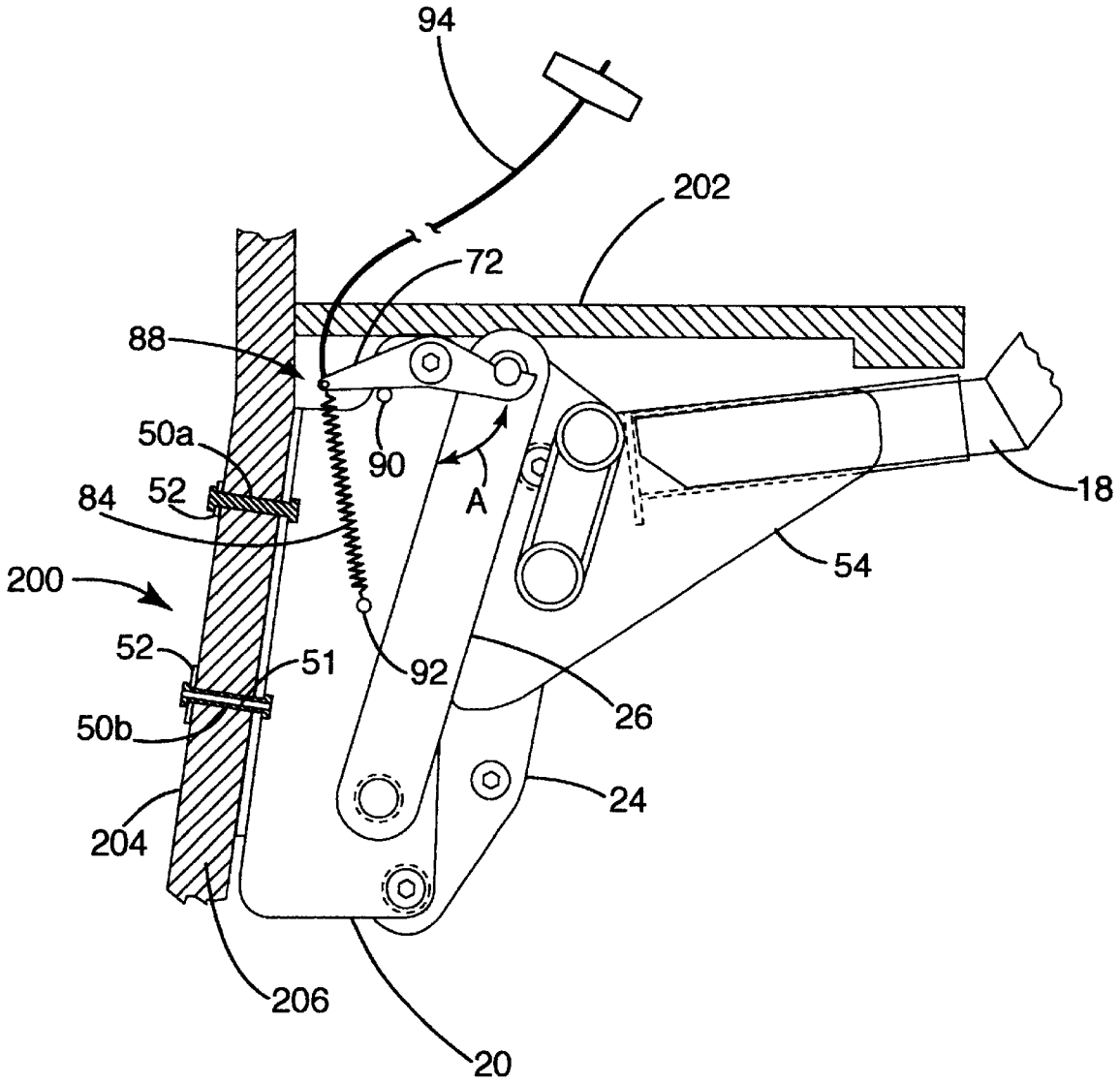
FIG. 8 is a cross-sectional view of the boat hull and dinghy lift.

As shown in FIG. 8, the lift assembly 12 is secured to the stern 204 by bolts 50*a–d*. The bolts 50*a–d* extend through the mounting plate 34 and the hull 206. Bolts 50*a* and 50*d* are preferably conventional bolts, while bolts 50*b* and 50*c* are preferably conventional oil-through bolts. As illustrated, these bolts 50*b* and 50*c* define an internal passage 51 through which hydraulic fluid can be routed. This eliminates the need to make separate holes through the hull 206 for hydraulic fluid lines. A washer 52 is fitted over each bolt 50*a–d* to distribute the compressive force over a larger portion of the hull 206. As an alternative to separate washers, a plate with a plurality of holes (not shown) can be fitted over multiple bolts.

Figure 11:
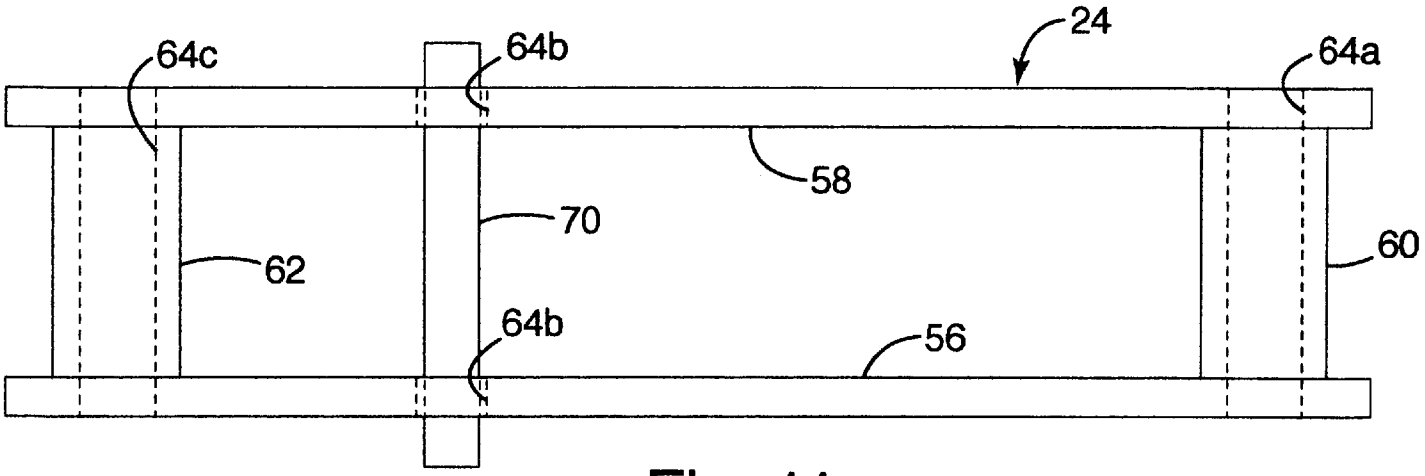
FIG. 11 is a front elevational view of the lever assembly.
Figure 12:
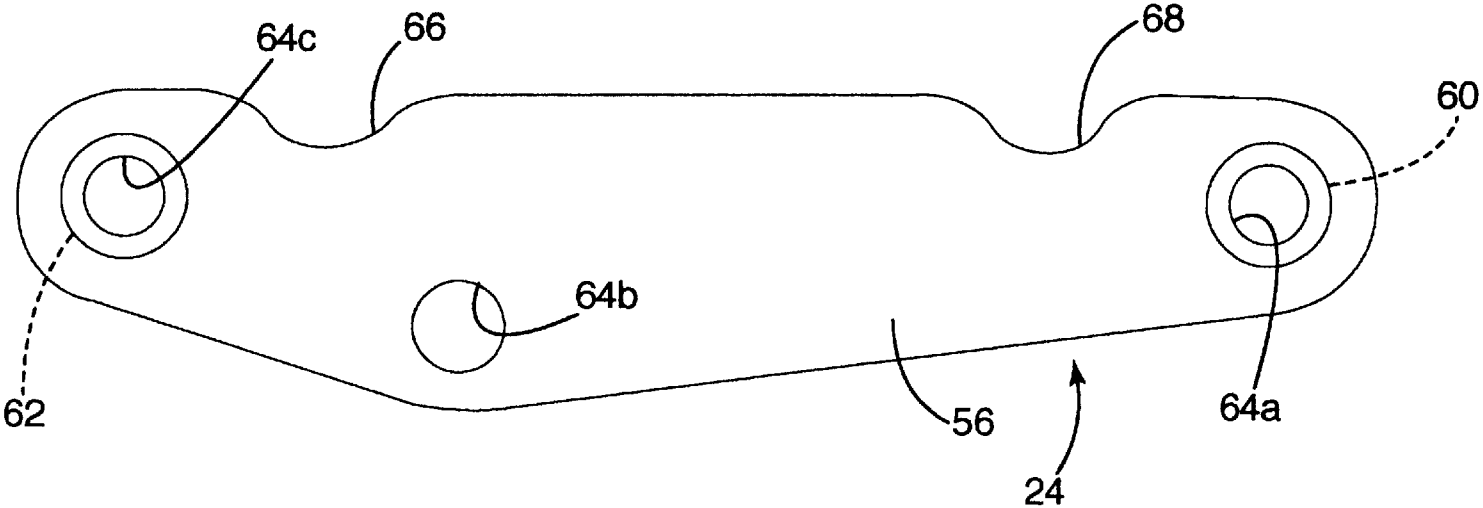
FIG. 12 is a side elevational view of the lever assembly.

The lever assembly 24 extends between the frame assembly 20 and the tip assembly 54. The lever assembly 24 is fitted within the frame sides 30 and 32, and is pivotally mounted over rod 100. Referring now to FIGS. 11 and 12, the lever assembly 24 generally includes a pair of arm sides 56 and 58 that are interconnected by sleeves 60 and 62. The sleeves 60 and 62 are preferably welded at opposite ends to the arm sides 56 and 58. Sleeve 60 is fitted over rod 100 to permit pivotal movement of the lever assembly 24 with respect to the frame assembly 20. The arm sides 56 and 58 are generally identical and each defines a plurality of throughbores 64*a–c*. Throughbores 64*a* and 64*c* are disposed toward opposite ends of the arm sides 56 and 58, and are concentrically aligned with sleeves 60 and 62, respectively. Each arm side 56 and 58 also defines a pair of recesses 66 and 68. The recesses 66 and 68 are somewhat semi-circular having a diameter substantially identical to the outer diameter of the sleeve 46. A rod 70 extends between throughbore 64*b* of arm side 56 and throughbore 64*b* of arm side 58. As described in more detail below, the rod 70 provides a mount for the lower end of hydraulic cylinder 22. Opposite ends of the rod 70 are drilled/tapped and the rod 70 is secured to the lever assembly 24 by bolts and retaining washers. As described in more detail below, sleeve 62 provides a mount for tip assembly.

Figure 13:
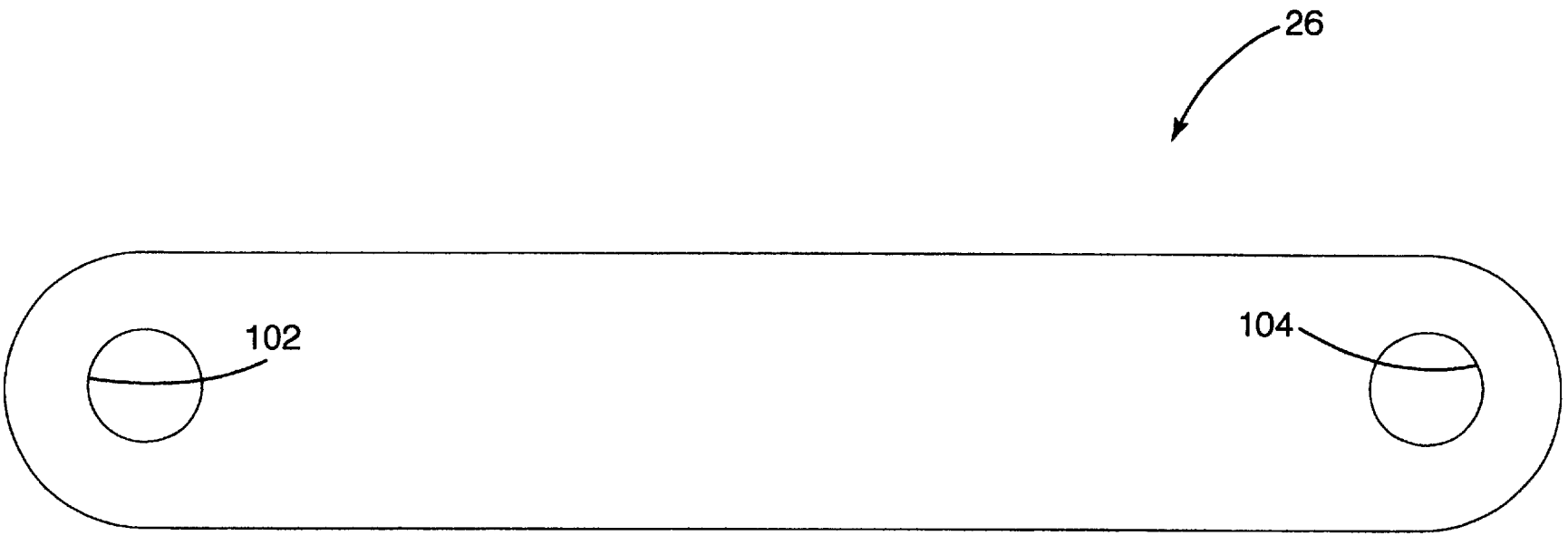
FIG. 13 is a side elevational view of the outer arm.

Each lift assembly 12 and 14 also includes a pair of outer arms 26 and 28 that are mounted between the frame assembly 20 and the tip assembly 54 (See FIG. 7). A side view of outer arm 26 is shown in FIG. 13. The outer arms 26 and 28 are generally identical, each defining mounting holes 102 and 104 disposed at opposite ends. Mounting holes 102 are fitted over opposite ends of a rod 106 extending through sleeve 46 of the frame assembly 20. A bronze bushing is preferably fitted within hole 102 in each outer arm 26 and 28. Further, a bronze washer is preferably fitted over each end of the rod 106 between the frame assembly 20 and the outer arms 26 and 28. Opposite ends of the rod 106 are drilled/tapped and the rod 106 is secured by bolts and retaining washers.

As noted above, each lift assembly 12 and 14 further includes a hydraulic cylinder 22. The hydraulic cylinder 22 is a generally conventional double-action, hydraulic cylinder. The cylinder 22 includes mounting sleeves 108 and 109 at opposite ends. The first mounting sleeve 108 is pivotally mounted over rod 48 of the frame assembly 20. The second mounting sleeve 109 is pivotally mounted over rod 70 of the lever assembly 24. Accordingly, extension and retraction of the cylinder caused pivotal movement of the lever assembly 24 about rod 100 of the frame assembly 20. Although the specifications of the hydraulic cylinder will vary from application to application, the hydraulic cylinder of the preferred embodiment is a 2½"×8¾" cylinder available from Prince of Sioux City Iowa.

Figure 14:
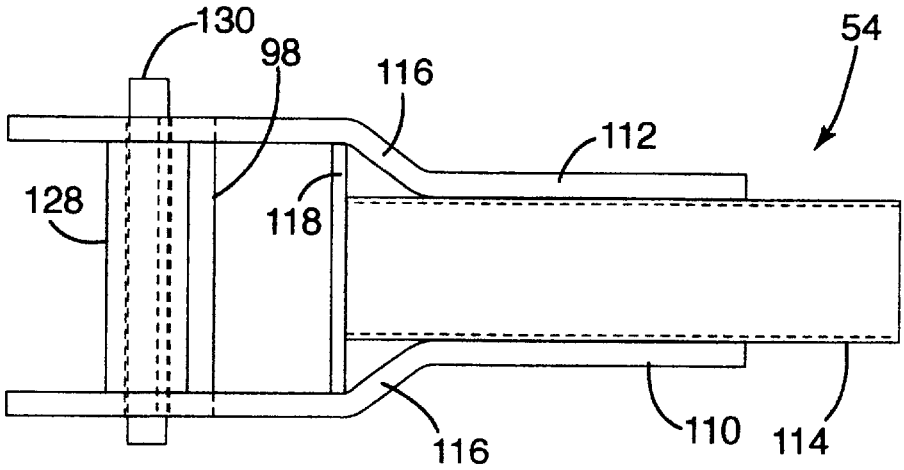
FIG. 14 is a top plan view of the tip assembly.
Figure 15:
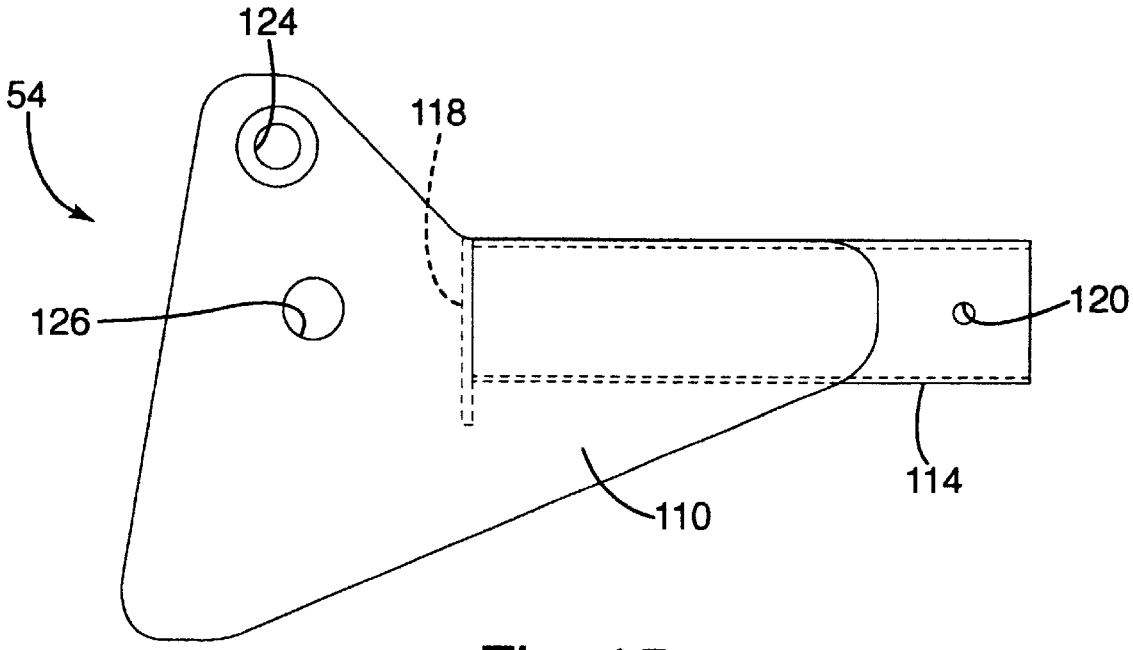
FIG. 15 is a side elevational view of the tip assembly.

A tip assembly 54 is mounted to each lift assembly 12 and 14 to provide a mounting structure for the removable arms 16 and 18. More specifically, each tip assembly 54 is mounted to both the lever assembly 24 and the outer arms 26 and 28 of the corresponding lift assembly 10 or 12 (See FIG. 7). The linkage in configured to cause the tip assembly to move from a substantially level orientation to a slight inward (i.e. toward the boat) tilt as the arms are raised (See FIGS. 24). Referring now to FIGS. 14 and 15, each tip assembly 54 generally includes a pair of mirror-image tip plates 110 and 112. At the inner end, the tip plates 110 are spaced approximately the same distance as the frame sides 30 and 32 of the frame assembly 20. This permits direct mounting of the lever assembly 24 and the outer arms 26 and 28. The outer ends of the tip plates 110 and 112 entrap a mounting tube 114. The mounting tube 114 is preferably narrower than the frame assembly 22. Accordingly, the tip plates 110 and 112 are preferably non-planar, including transition portions 116. The mounting tube 114 is preferably secured to the tip plates 110 and 112 by welding. A support plate 118 extends between the tip plate 110 and 112 immediately adjacent to the mounting tube 114. Locking pin holes 120 extend through the mounting tube 114 for locking the arms 16 and 18 in place with a locking pin 122. A pair of throughbores 124 and 126 extend through each tip plate 110 and 112. A sleeve 128 extends between the plates 110 and 112 in concentric alignment with throughbores 124. A rod 130 extends through sleeve 128 and protrudes from opposite ends of the tip assembly 54 to receive the outer arms 26 and 28. More specifically, the outer arms 26 are fitted over opposite ends of the 130 at mounting holes 104. A bronze bushing is preferably fitted within hole 102 in each outer arm 26 and 28. Further, a bronze washer is preferably fitted over each end of the rod 130 between the tip assembly 54 and the outer arms 26 and 28. Opposite ends of the rod 130 are drilled/tapped and the rod 106 is secured by bolts and retaining washers. The tip assembly 54 is mounted to the lever assembly 24 by a rod 98 that passes through sleeve 60. The rod 98 extends between the throughbores 126 on opposite tip plates 110 and 112 to provides a pivotal attachment. A bronze bushing is preferably fitted into each throughbore 126. Further, a pair of bronze washers are preferably fitted over opposite ends of the rod 98 between the lever assembly 24 and the tip assembly 54. Opposite ends of the rod 98 are preferably drilled/tapped and secured by a pair of bolts and retaining washers. The two tip assemblies 54 (and hence the two lift assemblies 12 and 14) are preferably interconnected by a cross member assembly 132 (See FIGS. 5 and 6). The cross member assembly 132 includes a pair of tubes 134 and 136 that extend between the inner tip plates 110 of the two tip assemblies 54. The tubes are preferably welded directly to the plates 110. A plurality of reinforcing tubes 138*a–c* extend between the two tubes 134 and 136. The reinforcing tubes 138*a–c* are preferably welded directly to the tubes 134 and 136.

As noted above, a separate arm 16 and 18 is removably mounted to each of the tip assemblies 54. More specifically, each arm 16 and 18 includes a main tube 140 that is slidably fitted within the mounting tube 114 of the corresponding tip assembly 54. The main tube 140 defines a pair of locking pin holes (not shown) that permit the arm 16 and 18 to be locked in place by a locking pin 122. To lock the arms in place, the locking pin 122 is inserted through the locking pin holes 142 in the main tube 140 and the locking pin holes 120 in the mounting tube 114. A cradle 144 is mounted to the free end of each arm 16 and 18. In the described embodiment, the cradle 144 has a shallow V-shaped configuration to correspond with the shape of the undersurface of dinghy 250. The cradle 144 may vary in shape from application to application to correspond with the shape of the undersurface of the appropriate dinghy. In some applications, it may be desirable for the arms 16 and 18 to be non-removable and instead be permanently affixed to the lift 10.

Figure 18:
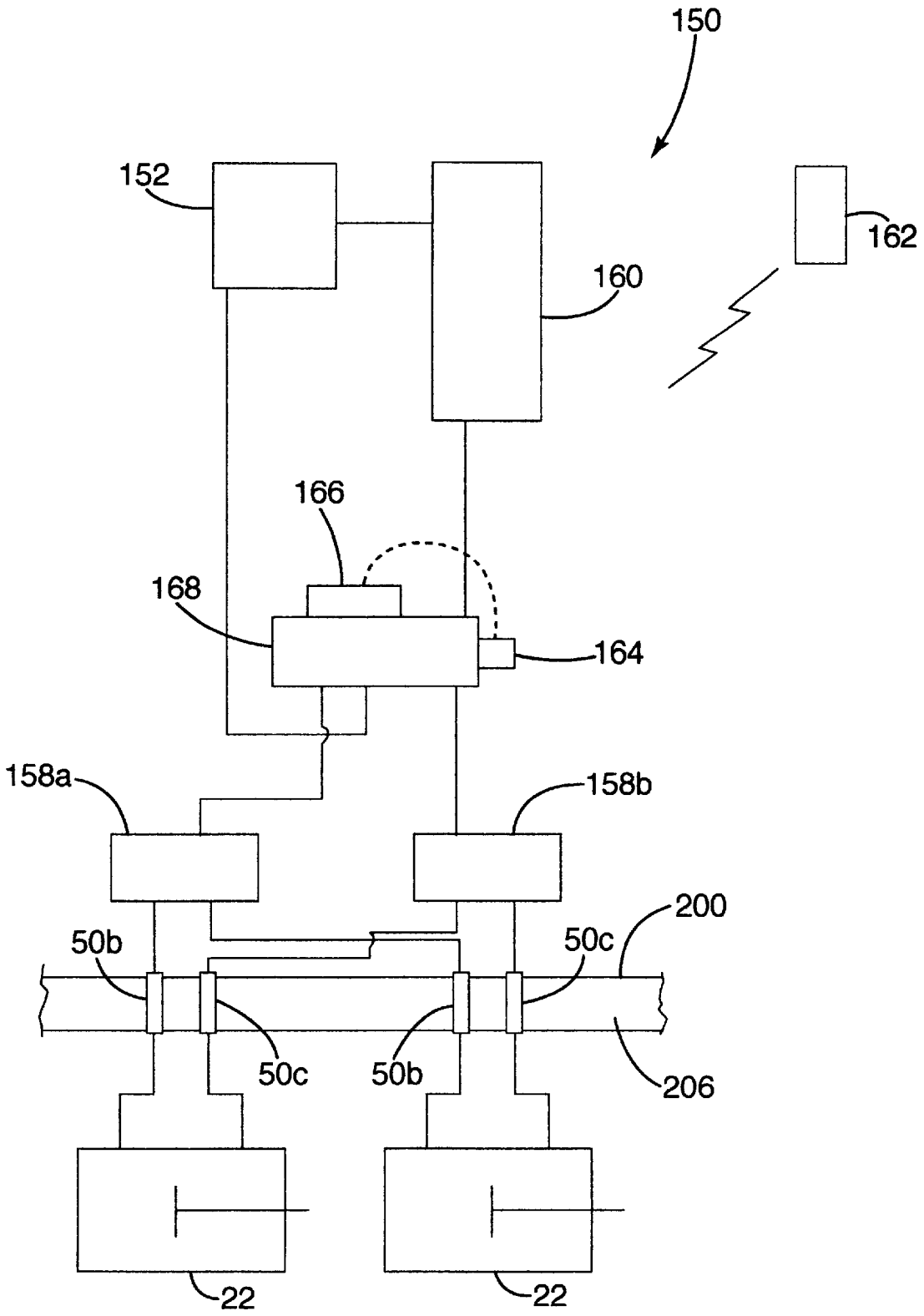
FIG. 18 is a schematic diagram of the hydraulic system.

The dinghy lift 10 is operated by a generally conventional hydraulic system 150 (See FIG. 18). The hydraulic system includes a hydraulic pump 152 and reservoir 160 that are connected to the hydraulic cylinders 22 by conventional hydraulic lines 154 and 156. As noted above, the hydraulic lines 154 on the interior of the boat 200 communicate with the hydraulic lines 156 on the exterior of the boat 200 via hollow bolts 50*b* and 50*c* that extend through the hull 206. The hydraulic system 150 preferably includes conventional flow controllers 158*a–b* that provides a substantially uniform volume of hydraulic fluid to both hydraulic cylinders 22. This helps to ensure uniform movement of the arms 16 and 18. The hydraulic system 150 is preferably operated by a conventional UHF remote control system. The remote control system is generally conventional and therefore will not described in detail. Suffice it to say that the system includes a conventional UHF remote 162 and a conventional UHF receiver 164. The UHF received 164 receives UHF signals from the remote 162 and provides appropriate operation of the hydraulic system 150, for example, by operation of a valve control solenoid 166. The hydraulic system 150 also preferably includes a conventional control panel (not shown) that permits operation of the dinghy lift in the event that the remote control 162 is lost or non-operational.

III. Detailed Description of Operation

Operation of the dinghy lift 10 will now be described beginning with the arms 16 and 18 removed and the dinghy lift 10 locked in the raised position. The arms 16 and 18 are installed by inserting the main tube 140 of each arm 16 and 18 into the mounting tube 114 of the corresponding tip assembly 54. The arms 16 and 18 are locked in place by locking pins 122 as described above. In this position, the arms 16 and 18 are above the waterline WL. Next, the latch assemblies 88 are released to unlock the lift assemblies 12 and 14. As noted above, a rope 94 extends from the latch 72 of each latch assembly 88. The latch assemblies 88 are released by pulling on the rope 94. As noted above, the latch 72 may alternatively be actuated by a solenoid (not shown).

Once the latch assemblies 88 have been released, the dinghy lift 10 can be lowered beneath the waterline WL to permit loading of the dinghy 250. The dinghy lift 10 is lowered by depressing the appropriate control button on the remote control 162. The UHF receiver 164 receives the control signal and actuates the valve control solenoid 166 so that the hydraulic pump 152 supplies hydraulic fluid to the extension end of each hydraulic cylinder 22. The flow controller 158*a* provides substantially even volume of hydraulic fluid to the two cylinders. As the cylinders 22 extend, the inner arm assemblies 24 pivots downwardly about rods 100. Because the inner arm assemblies 24 are linked to the tip assemblies 54, this causes each tip assembly 54 to travel through a corresponding downward arc. The arc has a vertical component that lowers the arms 16 and 18 and a horizontal component that moves the arms 16 and 18 away from the boat 200. The outer arms 26 and 28 provide a linkage between the frame assemblies 20 and the tip assemblies 54. As the lift 10 is lowered, this linkage causes the arms 16 and 18 to move from a slight inward (i.e. toward the boat) tilt to a substantially level orientation.

After the lift 10 is sufficiently lowered (e.g. the cradles 144 are fully below the waterline WL), the dinghy 250 is positioned over the arms 16 and 18 in alignment with the cradles 144. The lift 10 is then raised by depressing the appropriate button on the remote control 162. The UHF receiver 164 receives the control signal and actuates the valve control solenoid 166 so that the hydraulic pump 152 supplies hydraulic fluid to the retraction end of each hydraulic cylinder 22. The flow controller 158*b* provides a substantially even volume of hydraulic fluid to the two cylinders. As the cylinders 22 retract, the inner arm assemblies 24 pivot upwardly about rods 100. This lifts each tip assembly 54 in an upward arc having a vertical component that raises the arms 16 and 18 and a horizontal component that moves the arms 16 and 18 toward the boat 200. The outer arms 26 and 28 also cause the arms 16 and 18 to move from a substantially level orientation to a slight inward tilt as the lift 10 is raised. It should be noted that the configuration of the outer arms 26 and 28 can be varied to control the orientation of the tip assemblies 54 as they move. For example, the position and/or length of the outer arms can be configured to maintain the tip assemblies (and consequently the dinghy) in a substantially level orientation throughout the entire range of motion or to exaggerate the inward tilt as the lift is raised. As the lift 10 reaches its fully raised position, the sleeve 60 of each tip assembly 54 is caught by the corresponding latch assembly 88, thereby locking the lift 10 in the raised position with the dinghy supported well above the waterline WL.

Although the invention is described in connection with a boat having a swim platform, the present invention can also be installed on boats that do not include a swim platform. In such applications, the lift mechanisms are preferably installed on the stern at a position where they are fully below the waterline when the boat is at rest. Accordingly, the lift mechanisms remain hidden below water when the boat is at rest.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A combination comprising:

a boat having a stern and a swim platform mounted to said stern, said swim platform extending outwardly from said stern and having an outer extreme; and a dinghy lift mounted to said stern beneath said swim platform, said dinghy lift including a lift mechanism not extending outwardly beyond said outer extreme of said swim platform, said dinghy lift including at least one arm mounted to said lift mechanism, said arm extending outwardly beyond said outer extreme of said swim platform and being movable by operation of said lift mechanism between a raised position and lowered position, said arm being removably mounted to said lift mechanism, whereby said arm can be easily removed from said lift mechanism when not in use.

2. The combination of claim 1 further comprising a linkage means for maintaining said arm at a desired orientation as said arm moves between said raised position and said lowered position.

3. The combination of claim 2 wherein said dinghy lift includes two lift mechanisms and two arms, said stern having a vertical centerline, said lift mechanism being mounted to said stern on opposite side of said centerline, one of said arms being mounted to each of said lift mechanisms.

4. The combination of claim 3 wherein each of said lift mechanisms includes a frame assembly mounted to said stern, a lever assembly pivotally mounted to said frame assembly and a hydraulic cylinder extending between said frame assembly and said lever assembly, said hydraulic cylinder being operable to cause pivotal movement of said lever assembly with respect to said frame assembly.

5. The combination of claim 4 wherein said lift includes a tip assembly mounted to each of said lift mechanisms, said tip assembly mounted to said lever assembly of said corresponding lift mechanism and including a mounting tube for removably mounting said corresponding arm to said corresponding lift mechanism.

6. The combination of claim 5 wherein said linkage means includes an outer arm mounted between said frame assembly and said tip assembly of each lift mechanism, said outer arm being offset from said lever assembly.

7. The combination of claim 6 wherein said tip assemblies are rigidly secured to one another.

8. A combination comprising:

a boat having a swim platform, said swim platform extending outwardly from said boat to an outer extreme; and a dinghy lift mounted to said boat beneath said swim platform, said dinghy lift including a lift mechanism extending outwardly from said boat a distance less than said outer extreme of said swim platform, said dinghy lift further including an arm removably mounted to said lift mechanism, said arm extending beyond said outer extreme of said swim platform and being movable between a raised position and a lowered position by said lift mechanism.

9. The combination of claim 8 wherein said lift mechanism includes a frame assembly mounted to said boat, a lever assembly pivotally mounted to said frame assembly and a hydraulic cylinder extending between said frame assembly and said lever assembly, said hydraulic cylinder being operable to cause pivotal movement of said lever assembly with respect to said frame assembly.

10. The combination of claim 9 wherein said lift includes a tip assembly mounted to said lift mechanism, said tip assembly mounted to said lever assembly of lift mechanism and including a mounting tube for removably mounting said arm to said lift mechanism.

11. The combination of claim 10 further comprising a linkage means for maintaining said arm at a desired orientation as said arm moves between said raised position and said lowered position.

12. The combination of claim 11 wherein said linkage means includes an outer arm mounted between said frame assembly and said tip assembly, said outer arm being offset from said lever assembly.

13. The combination of claim 12 wherein said dinghy lift includes two spaced-apart lift mechanisms and two arms, one of said arms being mounted to each of said lift mechanisms.

14. The combination of claim 13 wherein said tip assemblies are rigidly secured to one another.

15. The combination of claim 14 wherein said arms are spaced from said boat a first distance when is said raised position and a second distance when in said lowered position, said second distance being greater than said first distance.

16. A dinghy lift for installation on a boat having a swim platform, comprising:

a lift mechanism mountable to the boat beneath the swim platform, said lift extending outwardly from the boat and having an outer extreme inwardly disposed from an outer extreme of the swim platform; and an arm removably mounted to said lift mechanism whereby said arm is removable from said lift mechanism when said dinghy lift is not in use, said arm extending beyond the outer extreme of the swim platform and including a cradle for support a dinghy, said arm being movable between a raised position and a lowered position through actuation of said lift mechanism.

17. The dinghy lift of claim 16 wherein said lift mechanism includes:

a frame assembly mountable to the boat beneath the swim platform;

a lever assembly pivotally mounted to said frame assembly; and a means for causing pivotal movement of said lever assembly with respect to said frame assembly.

18. The dinghy lift of claim 17 wherein said lift mechanism further includes a tip assembly mounted to said lever assembly, said tip assembly including an arm mount for removably mounting said arm to said tip assembly.

19. The dinghy lift of claim 18 wherein said means for causing pivotal movement is defined as a hydraulic cylinder extending between said frame assembly and said lever assembly.

20. The dinghy lift of claim 19 further comprising a linkage means for maintaining said arm at a desired orientation as said arm moves between said raised position and said lowered position.

21. The dinghy lift of claim 20 wherein said linkage means includes an outer arm mounted between said frame assembly and said tip assembly, said outer arm being offset from said lever assembly.

22. The dinghy lift of claim 21 wherein said outer arm is configured to cause movement of said arms toward the boat when said arms are moved from said lowered position to said raised position.

23. The dinghy lift of claim 22 wherein said outer arm is configured to cause said cradle to move from a substantially level orientation to an inwardly tilted orientation when said arms are moved from said lowered position to said raised position.

24. The dinghy lift of claim 23 wherein said dinghy lift includes two spaced-apart lift mechanisms and two arms, one of said arms being mounted to each of said lift mechanisms.

25. A combination comprising:

a boat having a stern and a waterline when said boat is at rest; and a dinghy lift mounted to said stern at a location beneath said waterline, said dinghy lift including a lift mechanism and at least one arm removably mounted to said dinghy lift, said arm being movable by operation of said lift mechanism between a raised position and lowered position, said arm being above said waterline when in said raised position and below said waterline when in said lowered position;

wherein said lift mechanism is fully disposed beneath said waterline in all positions of said arm.

26. The combination of claim 25 further comprising a linkage means for maintaining said arm at a desired orientation as said arm moves between said raised position and said lowered position.

27. The combination of claim 26 wherein said dinghy lift includes two lift mechanisms and two arms, said stern having a vertical centerline, said lift mechanisms being mounted to said stem on opposite side of said centerline, one of said arms being mounted to each of said lift mechanisms.

* * * * *